US005528997A

United States Patent [19]

Miller

[11] Patent Number: 5,528,997

[45] Date of Patent: Jun. 25, 1996

[54] FOLDING TABLE LEG MECHANISM

[75] Inventor: Grover L. Miller, Chrisney, Ind.

[73] Assignee: Kimball International, Inc., Jasper, Ind.

[21] Appl. No.: 257,743

[22] Filed: Jun. 9, 1994

[51] Int. Cl.[6] ..... A47B 3/00

[52] U.S. Cl. ..... 108/131; 108/132; 248/439

[58] Field of Search ..... 108/131, 127, 108/132, 130, 129, 123, 121, 125; 248/436, 439, 440.1, 188.6

[56] References Cited

U.S. PATENT DOCUMENTS

| | | | |
|---|---|---|---|
| 1,775,663 | 9/1930 | Wood | 108/125 |
| 2,054,755 | 9/1936 | Kovats | 108/125 |
| 2,178,172 | 10/1939 | Johnson | 311/88 |
| 2,277,917 | 3/1942 | Kovats | 248/439 |
| 2,343,537 | 3/1944 | De Saussure | 108/132 |
| 2,448,360 | 8/1948 | De Saussure | 108/132 |
| 2,730,372 | 11/1956 | Mahr | 108/131 X |
| 2,774,643 | 12/1956 | Gladsen et al. | 108/131 |
| 2,882,109 | 4/1959 | Eves et al. | 108/132 |
| 3,026,160 | 3/1962 | Bisp | 311/84 |
| 3,464,373 | 9/1969 | Larson | 108/125 |
| 3,777,675 | 12/1973 | Hanusiak | 108/132 |
| 4,444,124 | 4/1984 | Burr | 108/131 |
| 4,561,622 | 12/1985 | Heinzel | 108/131 X |
| 4,658,735 | 4/1987 | Holton | 108/131 |
| 4,714,224 | 12/1987 | Calmes | 248/465 |
| 4,827,851 | 5/1989 | Diffrient | 108/132 |
| 4,838,180 | 6/1989 | Gutgsell | 108/132 |
| 4,986,195 | 1/1991 | Diffrient | 108/150 |
| 5,109,778 | 5/1992 | Berkowitz | 108/127 |
| 5,279,233 | 1/1994 | Cox | 108/129 |
| 5,357,872 | 10/1994 | Wilmore | 108/132 X |

FOREIGN PATENT DOCUMENTS

| | | | |
|---|---|---|---|
| 914494 | 1/1963 | United Kingdom | 108/130 |

*Primary Examiner*—Peter M. Cuomo
*Assistant Examiner*—Janet M. Wilkens
*Attorney, Agent, or Firm*—Baker & Daniels

[57] ABSTRACT

A folding table having a leg pivotally connected to the bottom surface having a locking mechanism including two pairs of linkage members attached to opposite sides of the leg. The two pairs of links allow a slight overrotation of the leg during its closing movement to thereby lock it in position. By the orientation of the links, a bias force is created to maintain the leg in a closed position. A resilient U-shaped spring clamp is attached to capture the leg in its closed position. A separate resilient locking latch engages the pivoting links when the leg is in its open, unfolded position.

9 Claims, 3 Drawing Sheets

FOLDING TABLE LEG MECHANISM

BACKGROUND OF THE INVENTION

The present invention relates generally to folding furniture and more particularly to tables having legs that fold compactly underneath the table top.

Folding tables are widely used and derive their primary benefit from ease in which they can be handled and stored within their folded condition. Folding tables are well known and are commonly used in homes, offices, training rooms, cafeteria, etc. when extra table space is needed. When not needed, the tables are folded up and stored in some unobtrusive manner.

To prevent the table from collapsing during use, folding tables commonly include some mechanism for locking the table legs in their unfolded position. Some locking mechanisms do not securely lock the legs open and may be prone to folding during use. Additionally some designs might also lead to accidental finger pinches while unlocking the mechanism. Other mechanisms available in the prior art, while suitable for their intended purposes, are complicated in construction or expensive in their manufacture or both.

It is also desirable to hold the legs in their closed folded position to prevent the legs from accidentally unfolding during transportation of the table or while the table is stored.

SUMMARY OF THE INVENTION

The present invention overcomes the disadvantages of the above described prior art by providing a folding table having a table top with a leg pivotally connected to the bottom surface of the table so that it may be moveable from between an open unfolded position to a closed position. Two pairs of linkage members are attached on opposite sides of the leg, both to the leg and to the table surface to increase the support characteristics of the table.

In one form of the invention, the two pairs of links allow a slight overrotation of the leg during its closing movement thereby permitting it to lock into place. By the orientation of the links, a bias force is created by the leg between the links to thereby maintain the leg in close contact with the bottom table surface.

In another form of the invention, a resilient U-shaped spring clamp is attached to the bottom table surface so that the table leg may rotate into and become captured by the upstanding ends of the U-shaped spring, thereby further preventing unexpected or accidental opening of the table leg.

In another form of the invention, a pair of resilient locking latches spring outwardly into engagement with the pivoting links to lock the leg in its full, open, unfolded position.

An advantage of the folding table leg mechanism of the present invention, according to one form thereof, is its easy locking mechanism to resiliently lock the leg in its supporting position while additionally including a lock mechanism which permits overrotation of the links to bias the leg toward the table in its folded position.

Another advantage of the folding table leg mechanism of the present invention is that of a U-shaped bracket which acts as a fail safe to the previously mentioned overrotation lock mechanism.

Yet another advantage of the folding table leg mechanism of the present invention is that it reduces the possibility of finger pinches when unlocking the legs from either their folded or unfolded positions and is easy to use.

The invention, in one form thereof, provides a folding table including a table surface having a top surface and a bottom surface. A table leg, rotatably received within a housing attached to the table, is rotatable from a supporting position to a folded position. A pivoting linkage mechanism is included having a first link and a second link. The first link is pivotally connected to the leg and second link while the second link is pivotally connected to the housing. This linkage mechanism prevents rotation of the leg past a supporting position while allowing overrotation of the leg past a folded position to where the first link becomes reversed biased against the second link thereby locking the leg relative to the table.

The invention, in another form thereof, provides a table surface with a table leg rotatably received within a housing attached to the table. A pivoting linkage mechanism is included having a pair of link assemblies each pivotably attached to the leg at diametrically opposite locations with each link assembly including a first link and a second link. The first link is pivotally connected to the leg and second link while the second linkage is further pivotally connected to the housing. The linkage mechanism prevents rotation of the leg past a supporting position while allowing overrotation of the leg past a folded position to where the first link becomes reversed biased against the second link thereby locking the leg relative to the table. A resilient locking latch attached to either the table or housing, locks and engages one of the links when the leg is in a supporting or unfolded position.

The invention in still another form, provides a table surface having a top surface and a bottom surface to which a housing is attached. A table leg is rotatably received within the housing while a pair of pivoting linkage mechanisms located on diametrically opposed sides of the leg attach to the housing or table. The linkage mechanism prevents rotation of the leg past a supporting position and allows overrotation of the leg past the folded position to where the first link becomes reversed biased against the second link and locks the leg relative to the table.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
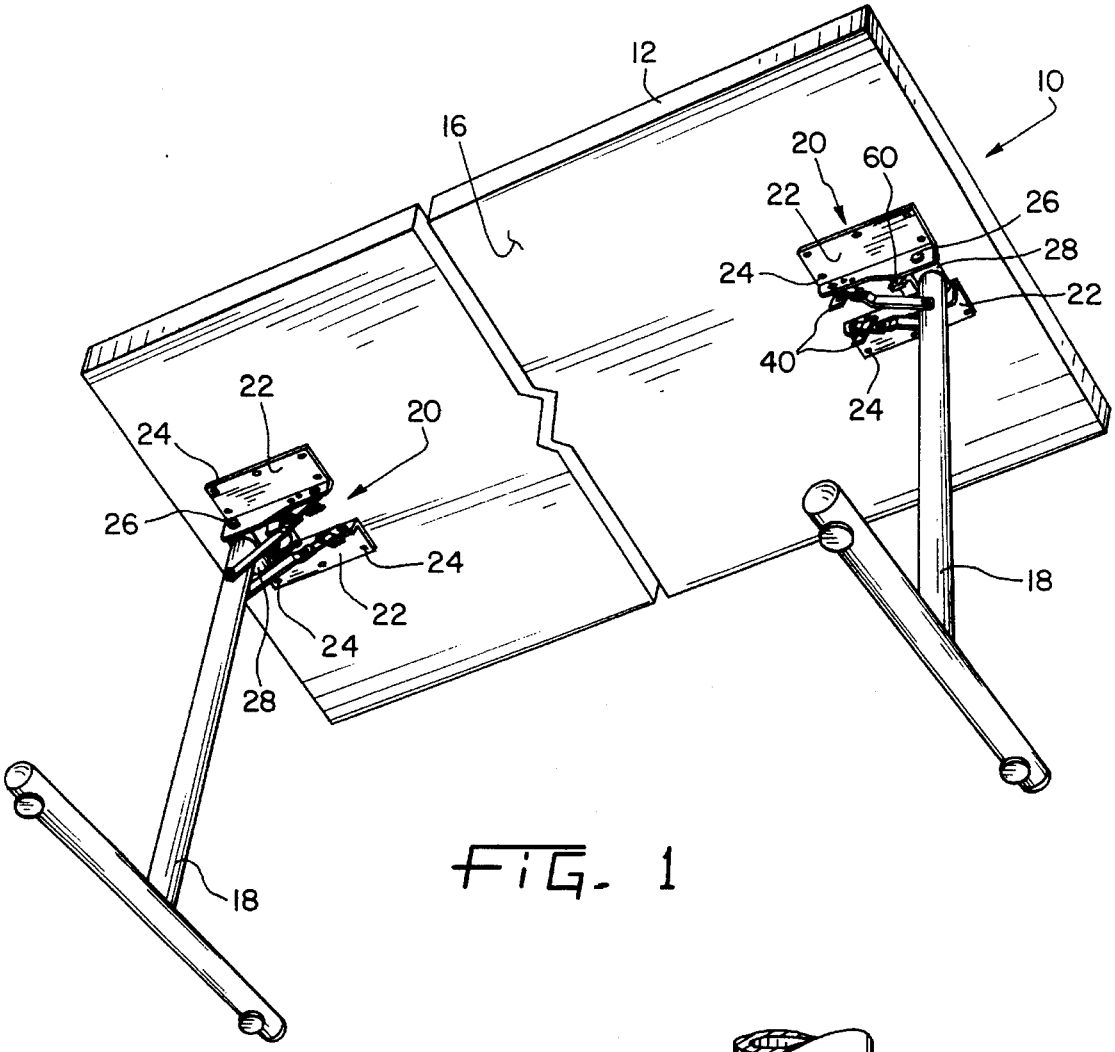
FIG. 1 is a perspective view of the underside of the folding table of the present invention.
Figure 2:
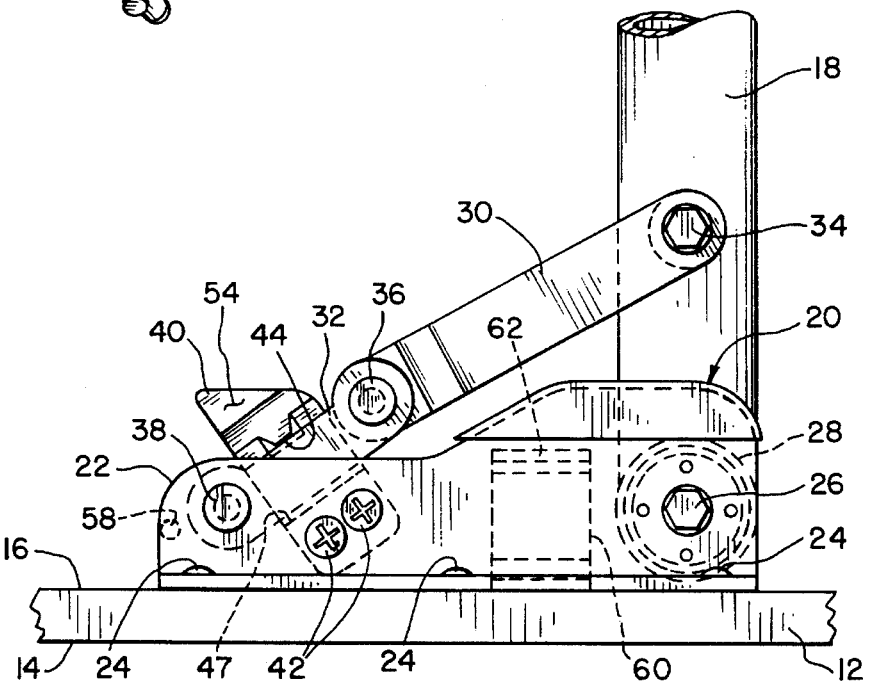
FIG. 2 is a fragmentary side elevational of the folding table leg mechanism.

An exemplary embodiment of the invention is shown in the drawings, in particular by referring to FIGS. 1 and 2, in which table 10 is shown a table top 12 having a top surface 14 and a bottom surface 16. A pair of legs 18, as shown in FIG. 1, are placed opposite one another on bottom surface 16. Each leg 18 is pivotably mounted to table bottom 16 by means of a housing 20 formed from two L-shaped brackets 22. Brackets 22 are attached by fasteners such as screws 24 to bottom surface 16. Leg 18 pivots or rotates about a pivot pin or axle 26 which connects through an L-shaped bracket 22 through leg 18. Leg 18 includes a T-shaped end 28 through which pivot pin 26 is inserted. Pivot pins or axle 26 may be constructed in a known fashion utilizing a threaded steel rod or bolt. The leg further includes a longitudinal leg axis coplanar with the connection between the leg and the housing. The leg axis is generally parallel to the table top when the leg is in a folded position.

Figure 3:
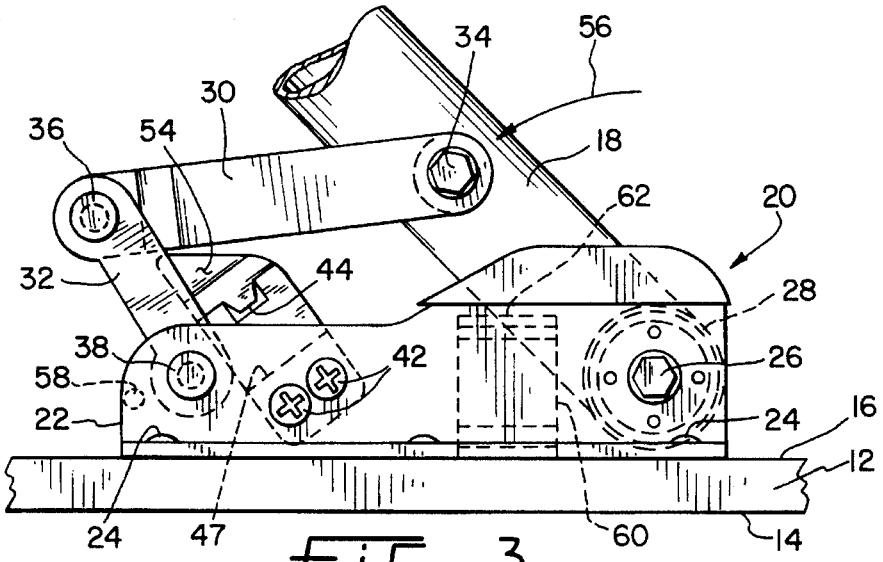
FIG. 3 is a fragmentary side elevational view of the folding table mechanism in a slightly folded position.

As most clearly shown in FIGS. 2 and 3, leg 18 is further attached to housing 20 by means of a linkage mechanism constructed from two pairs of linkages attached on diametrically opposing sides of leg 18. Each pair of linkages includes a first link 30 and a second link 32.

As shown in FIG. 2, link 30 is rotatably attached by means of a pivoting connection 34 to leg 18. A second pivoting connection 36 connects first link 30 to second link 32. A third pivoting connection 38 attaches second link 32 to L-shaped bracket 22 of housing 20. These pivoting connections 34, 36 and 38 may be constructed in known ways such as by rivets, bolts or shaped pins. As shown in the drawings, first link 30 is greater in length than second link 32.

Figure 8:
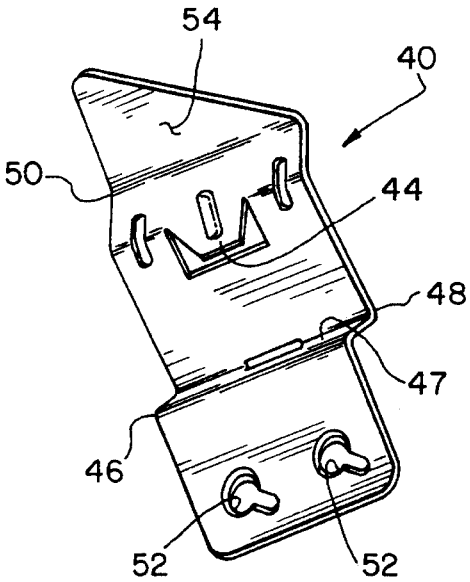
FIG. 8 is a perspective view of the resilient locking latch of the folding table leg mechanism.

When leg 18 is in its fully open or extended position, a resilient locking latch 40 attached to each L-shaped bracket 22 by screws 42, engages and locks second link 32 by means of an overhanging tab 44. As shown in FIG. 8, locking latch 40 may be formed from a pressed or formed sheet of metal or plastic. As shown in FIG. 8, locking latch 40 includes a number of curves or bends 46, 48 and 50 that permit locking latch 40 to engage second link 32 in an outward direction away from leg 18 whereby latch 40 does not interfere with intermediate leg movement and overhanging tab 44 may clip over second link 32. Openings 52 are attachment locations for screws 42 to bracket 22. Because of the resilient characteristics of the thin metal or plastic of locking latch 40, locking latch 40 will automatically engage and lock the linkage when leg 18 is in its full upright position thereby preventing closure. Additionally, an area 47 of latch 40 between bends 46 and 48 operates as a stop to prevent leg 18 from opening past a position perpendicular to table 12. To close leg 18 and disengage latch 40, a user will grasp triangular pad shaped area 54 of latch 40 and squeeze the two locking latches 40 towards each other thereby disengaging each overhang tab 44 from second link 32. At this time, leg 18 may be folded toward bottom surface 16 as shown in FIG. 3 in the direction of arrow 56.

Figure 4:
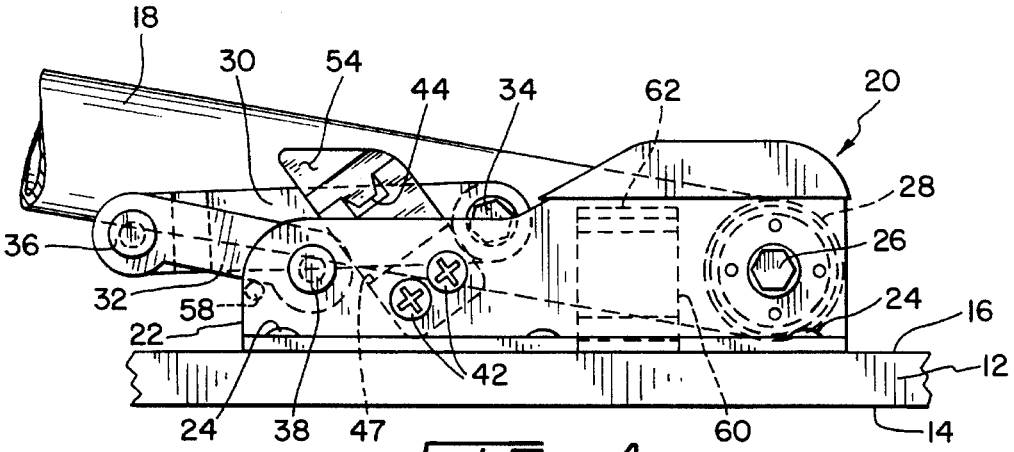
FIG. 4 is a fragmentary side elevational view of the folding table leg mechanism at a point prior to overrotation.
Figure 5:
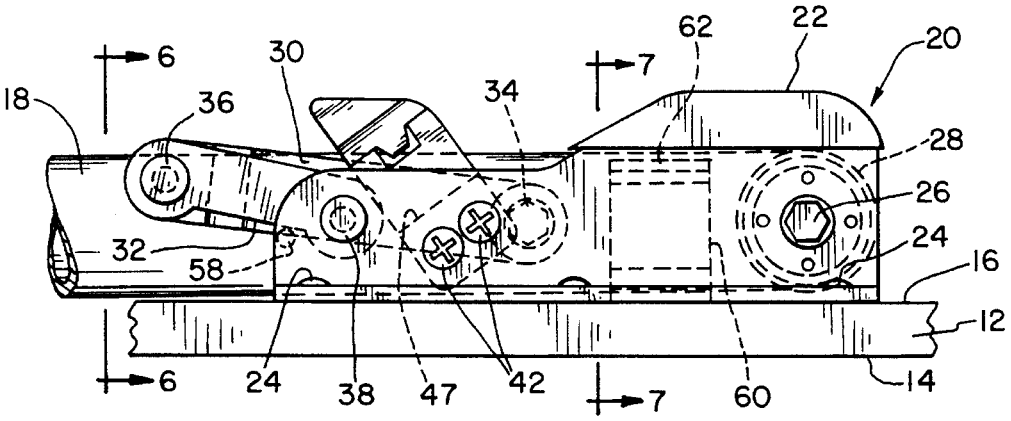
FIG. 5 is a fragmentary side elevational view of the folding table leg mechanism in its overrotated state.
Figure 6:
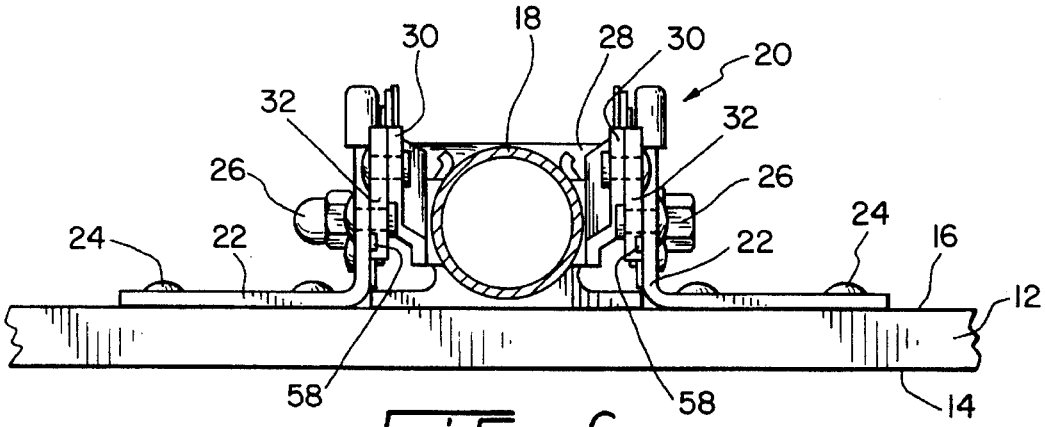
FIG. 6 is a cross sectional view of the folding table leg mechanism in its overrotated state.

As leg 18 continues to fold toward bottom surface 16, it comes to a point where it is almost nearly folded, as shown in FIG. 4. Each L-shaped bracket 22 includes a catch or protuberance 58 directed inwardly that interferes with the pivoting movement of each second link 32. This interference causes second link 32 to stop pivoting. On continued rotation, leg 18 will overrotate about pivot pin 36 and based upon the particular dimensions of the links, first link 30 will move into a biased position as shown in FIG. 5. The force necessary to squeeze first link 30 to the stable biased state in which pivot point 36 is located behind leg 18 as viewed from bottom surface 16, causes a stable locked condition of the leg to form, thereby preventing leg 18 from opening accidentally. A slight stretching of first and second links 30 and 32 occurs during overrotation of leg 18, at a point where link 30 is parallel to leg 18. Once leg 18 is rotated past that point, leg 18 will not accidentally unfold.

Figure 7:
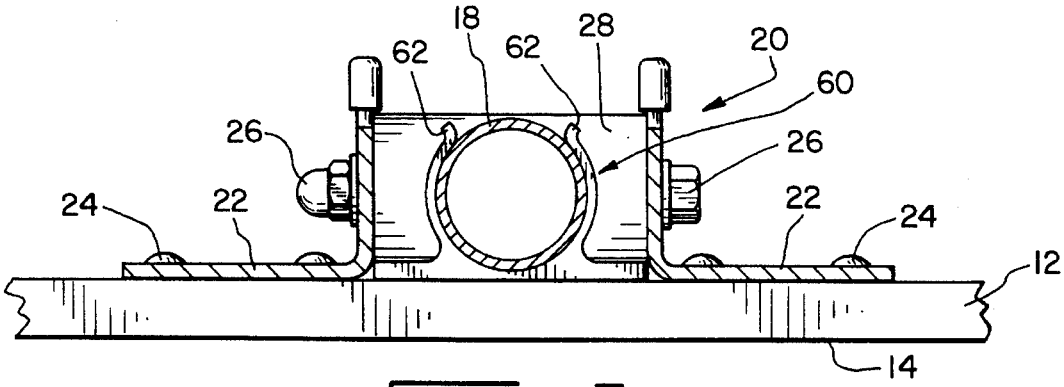
FIG. 7 is a cross sectional view of the folding table leg mechanism.

As shown in FIG. 7, a complimentary and supplementary device such as resilient U-shaped member 60 may be utilized to ensure the positive locking of leg 18 relative to table top 12. As shown in FIG. 7, U-shaped member 60 includes two curved, upstanding legs 62 that are formed to receive leg 18 when it is in its totally folded position. Member 60 is made from a resilient material such as metal or plastic to maintain leg 18 in an enveloped position until intentionally moved to an unfolded or open position.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A folding table comprising:

a table top having a top surface and a bottom surface;

a housing attached to said table top bottom surface;

a table leg rotatably connected to said housing, said table leg rotatable from a supporting position to a folded position, said table leg defining a longitudinal leg axis coplanar with said connection between said leg and said housing, said leg axis generally parallel to said table top when said leg is in said folded position; and a pivoting linkage mechanism including a first link and a second link, said first link being longer than said second link and being pivotally connected to said table leg and said second link, said second link pivotally connected to said housing, said linkage mechanism preventing rotation of said table leg past said supporting position, said first link and said second link being constrained to fold together in a manner whereby said connection between said first link and said second link moves away from said connection between said table leg and said housing when said table leg is folded from said supporting position to said folded position, whereby said table leg overrotates to a point where said leg axis is between said table top and said connection between said first link and said second link and therefore is biased against said table top.

2. The folding table of claim 1 further comprising a pair of said pivoting linkage mechanisms each located diametrically opposite each other on said table leg.

3. The folding table of claim 1 in which said pivoting linkage mechanism further includes a one-piece resilient one-piece locking latch, said latch locking and engaging a said link when said leg is in said supporting position.

4. A folding table comprising:

a table top having a top surface and a bottom surface;

a housing attached to said table top bottom surface;

a table leg rotatably connected to said housing, said table leg rotatable from a supporting position to a folded position, said table leg defining a longitudinal leg axis coplanar with said connection between said leg and said housing, said leg axis generally parallel to said table top when said leg is in said folded position;

a pivoting linkage mechanism including a pair of link assemblies each pivotally attached to said table leg at diametrically opposite locations, each link assembly including a first link and a second link, said first link being longer than said second link and being pivotally connected to said table leg and said second link, said second link pivotally connected to said housing, said linkage mechanism preventing rotation of said table leg past said supporting position, said first link and said second link being constrained to fold together in a manner whereby said connection between said first link and said second link moves away from said connection between said table leg and said housing when said table leg is folded from said supporting position to said folded position, whereby said table leg overrotates to a point where said leg axis is between said table top and said connection between said first link and said second link and therefore is biased against said table top; and a one-piece resilient locking latch, said latch locking and engaging a said link when said leg is in said supporting position.

5. The folding table of claim 4 in which said resilient locking latch is biased into engagement with a said link whereby hand power is necessary to disengage said latch prior to moving said table leg to said folded position.

6. The folding table of claim 5 in which said locking latch is attached to said housing.

7. The folding table of claim 4 in which said locking latch is engagable With said second link.

8. A folding table comprising:

a table top having a bottom surface;

a table leg rotatably connected to said bottom surface, said table leg rotatable from a supporting position to a folded position, said table leg defining a longitudinal leg axis coplanar with said connection between said table leg and said bottom surface, said leg axis generally parallel to said table top when said leg is in said folded position; and a pair of pivoting linkage mechanisms located on diametrically opposed sides of said table leg, each said mechanism including a first link and a second link, said first link being longer than said second link and being pivotally connected to said table leg and said second link, said second link pivotally connected to said bottom surface, said linkage mechanism preventing rotation of said table leg past said supporting position, said first link and said second link being constrained to fold together in a manner whereby said connection between said first link and said second link moves away from said connection between said table leg and said bottom surface when said leg is folded from said supporting position to said folded position, whereby said table leg overrotates to a point where said leg axis is between said table top and said connection between said first link and said second link and therefore is biased against said table top.

9. The folding table of claim 8 in which said pivoting linkage mechanism further includes a one-piece resilient locking latch, said latch locking and engaging a said link when said table leg is in said support position.

* * * * *